US005143447A

United States Patent [19]

Bertenshaw

[11] Patent Number: 5,143,447

[45] Date of Patent: Sep. 1, 1992

[54] LAMP SYSTEM HAVING A TORROIDAL LIGHT EMITTING MEMBER

[76] Inventor: David R. Bertenshaw, 35 Ridgeway Close, Lightwater, Surrey GU18 5XX, England

[21] Appl. No.: 740,295

[22] Filed: Aug. 5, 1991

[51] Int. Cl.[5] ..... F21Y 7/14

[52] U.S. Cl. ..... 362/297; 362/299; 362/346; 313/578

[58] Field of Search ..... 362/296, 297, 346, 347, 362/350, 299; 313/578, 579, 580

[56] References Cited

U.S. PATENT DOCUMENTS

| | | | |
|---|---|---|---|
| 1,711,478 | 4/1929 | Halvorson, Jr. | 362/350 |
| 1,753,885 | 4/1930 | Gerhardt | 362/350 |
| 2,415,635 | 2/1947 | Hopkins | 362/350 |
| 2,846,565 | 8/1958 | Binkley et al. | 362/350 |
| 2,886,735 | 5/1959 | Anderson | 313/578 |
| 3,654,512 | 4/1972 | Spiteri | 313/578 |
| 4,379,249 | 4/1983 | Walsh | 313/578 |

*Primary Examiner*—Richard R. Cole
*Attorney, Agent, or Firm*—J. E. Brunton

[57] ABSTRACT

A lamp assembly particularly for a luminaire comprising a lamp having a light emitting member of generally torroidal shape and a reflector positioned and shaped to reflect light received from the light emitting member through the central opening. The light emitting member is preferably a filament of an incandescent lamp. The reflector has a cross-section comprising first and second arcs which are substantially symmetrical with respect to a line joining the center of the reflector and a point substantially at the center of the torroidal member and the shape of the reflector is that described by rotating the arcs about the line. The arcs may be elliptical or circular for example with their foci or centers positioned to achieve the required effect.

20 Claims, 5 Drawing Sheets

LAMP SYSTEM HAVING A TORROIDAL LIGHT EMITTING MEMBER

FIELD OF THE INVENTION

This invention relates to lamps and is particularly applicable to luminaires for use in the entertainment industry, such as in theatres.

DESCRIPTION OF BACKGROUND ART

It is well known to provide a lamp assembly comprising a light source, such as an incandescent bulb, which emits light in a multitude of directions, and a reflector positioned adjacent the source to direct light emitted rearwardly from the source in a forward direction. The object is to make use of as much as possible of the light energy emitted by the source. The problem which arises, however, is that the light source itself is in the path of some of the light reflected by the reflector and thus prevents that light from being usefully employed.

With a view to solving the above problem, it is known to provide a lamp comprising an incandescent bulb including a filament formed with a number of spaced apart parallel segments and a spherical mirror arranged for reflecting light through the gaps between the segments. However, practical difficulties are involved in implementing this proposal since a filament of this structure is somewhat mechanically unstable and the tolerances required to implement this reliably difficult to achieve.

SUMMARY OF THE INVENTION

The invention aims to alleviate this problem.

In one aspect, the invention provides a reflector for use with a light source of torroidal shape, the reflector being shaped so that with the light source appropriately positioned, reflected light may be directed through the torroid.

In a further aspect, the invention provides an assembly of a lamp and reflector, the lamp comprising a torroidal light source and the reflector being arranged to reflect light through the central area thereof.

DESCRIPTION OF THE DRAWINGS

The invention is described further by way of example with reference to the accompanying drawings, in which.

DESCRIPTION OF PREFERRED EMBODIMENTS

Figure 1:
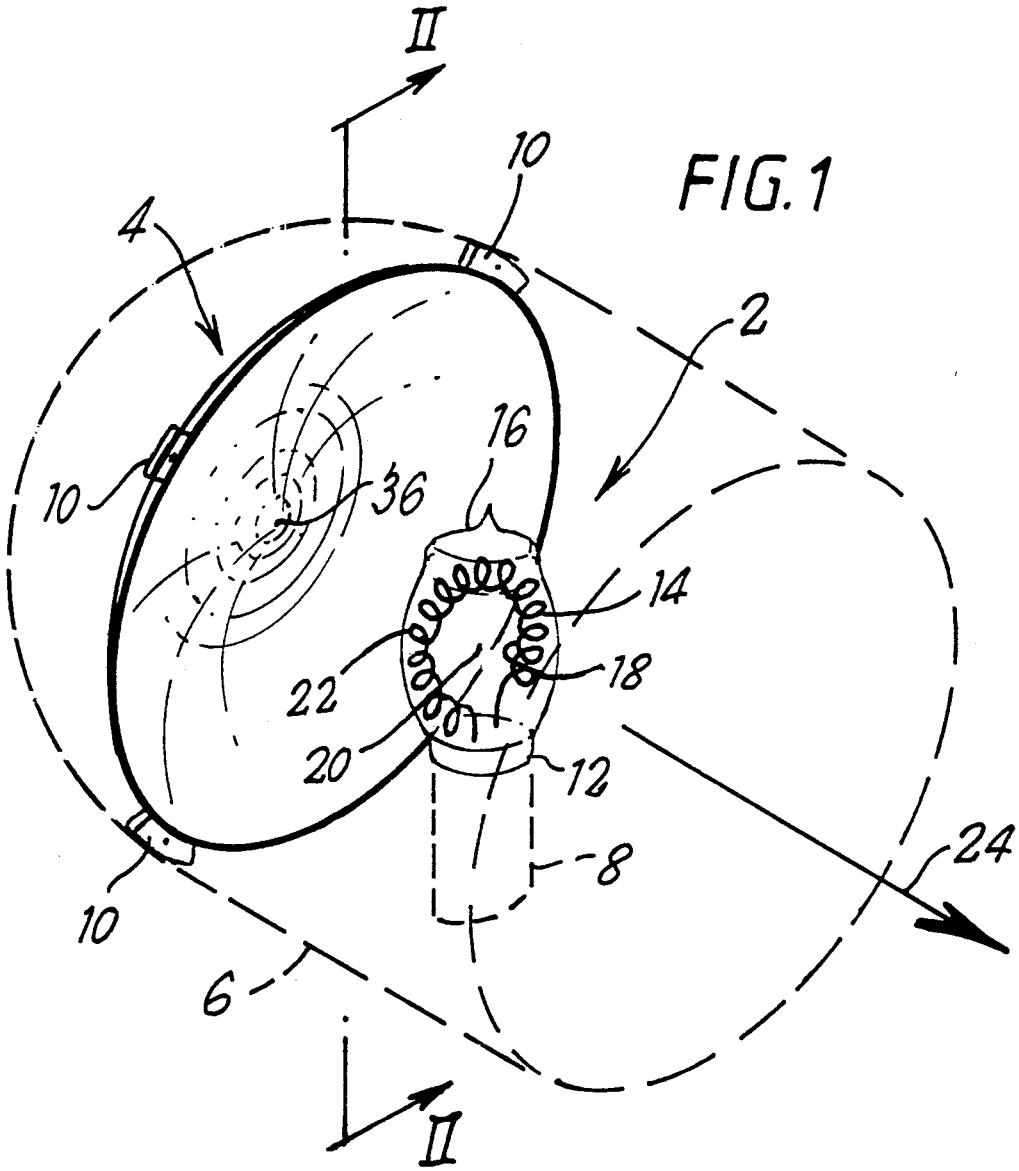
FIG. 1 is a diagrammatic perspective view of a lamp assembly according to a first embodiment of the invention.

The lamp assembly shown in FIG. 1 comprises an incandescent bulb 2, a reflector 4, a housing 6 shown in broken lines, a support 8 also shown in broken lines on which the bulb 2 is mounted in the housing 6 and further supports 10 by which the reflector 4 is mounted in the housing 6.

The bulb 2 comprises a base 12 supporting a filament 14 and a glass envelope 16. The filament 14 comprises wire wound in the form of a helix and the helix axis is of generally circular shape so that the filament itself is torroidal. The inner perimeter 18 of the torroidal filament 16 thus defines a central opening 20 within the filament and this is preferably a substantial percentage of the total area bounded by the outer perimeter 22 of the filament 16. This percentage is preferably at least 50% and may, for example, be in the range 50% to 70%. Electrical pins (not shown) connected to the filament 16 are carried by the base 12 and engage in corresponding sockets (not shown) in the support 8. Arrow 24 indicates the forward direction in which it is desired to direct the light produced when the bulb 14 is energised.

Figure 2:
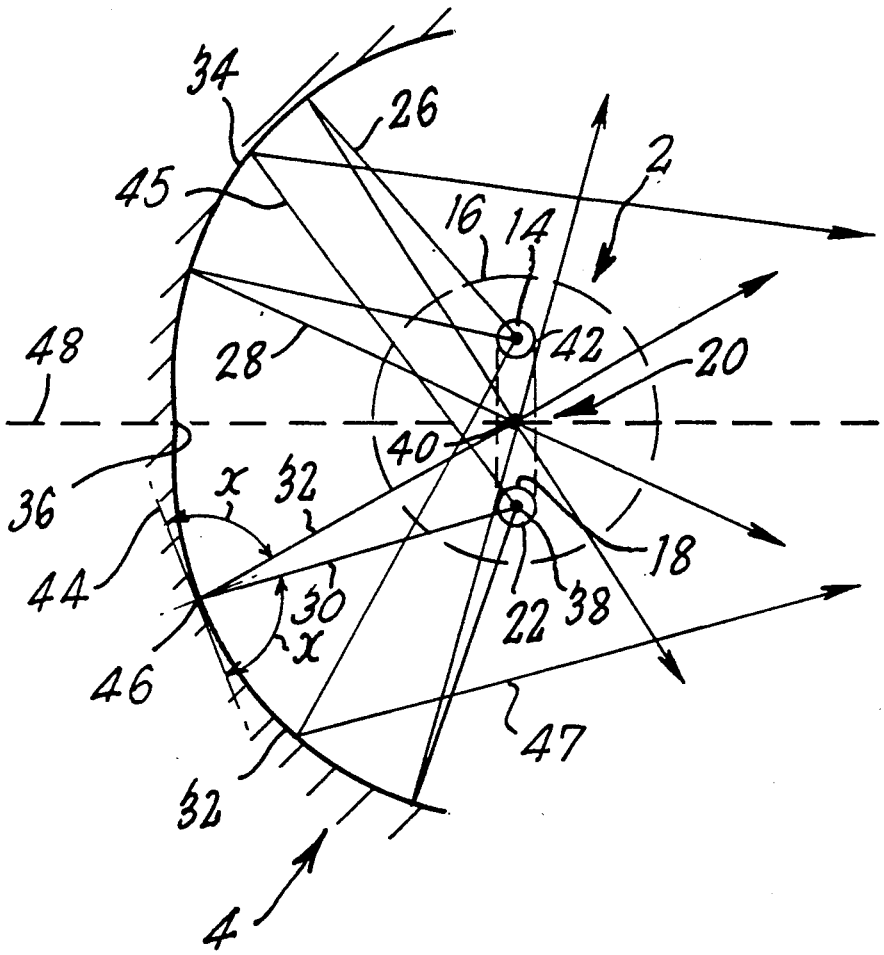
FIG. 2 is a diagrammatic section on the line II—II shown in FIG. 1.

As will be appreciated, a significant part of the light emitted by filament 14 is directed towards the reflector 4. The filament 14 and reflector 4 are arranged so that, after reflection at the reflector 4, a substantial proportion of such light passes back through the central opening 20 in the torroidal filament. This is illustrated in FIG. 2 in which, by way of example, three rays 26, 28, 30 are shown as being emitted towards the reflector 4 and reflected back through the opening 20. In order to achieve this, the cross-section of the reflector 4 comprises two elliptical arcs 32, 34 which meet at the centre 36 of the reflector. The foci of the elliptical arc 32 are located at points 38 and 40 respectively and the foci of elliptical arc 34 are located respectively at the point 40 and at a further point 42. The torroidal filament 14 is arranged so that the centre of the torroid is also located substantially at point 40 and opposed points substantially at the centre of the helical filament 14 are located respectively at points 38 and 42.

As is well known, an ellipse has the property that the two lines joining a point on the curve to the respective foci make equal angles to a tangent at that point. Thus, light rays from the filament 14 appearing to emanate from point 38 or 42 and impinging repectively on the arc 32 or 34 are reflected back through point 40. To make this clear, a tangent 44 has been drawn in FIG. 2 at point 46 where the ray 30 is incident upon the ellipse 32 and the angles between the tangent 44 and the incident ray 30 and reflected ray 32 are shown to be equal, the reflected ray 32 passing through point 40. Rays such as ray 45 appearing to emanate from point 38 but impinging on arc 34 are reflected forwardly in a zone outside the filament 14 without impinging on the filament and rays such as ray 47 appearing to emanate from point 42 but impinging upon arc 32 are reflected in the same manner. Of course, in practice, not all rays emitted by the filament 14 will appear to emanate from points such as 38 and 42 at the centre of the helix. However, a substantial part of the light emitted towards the reflector 4 by filament 14 will nevertheless be returned through the open central region 20 or to the exterior of the filament 14 without being interrupted by the filament 14 itself.

On consideration of FIGS. 1 and 2, it will be appreciated that the shape of the reflector 4 is that shape which would be described by rotating the elliptical arcs 32 and 34 about the axis 48 which passes through points 36 and 40.

Figure 3:
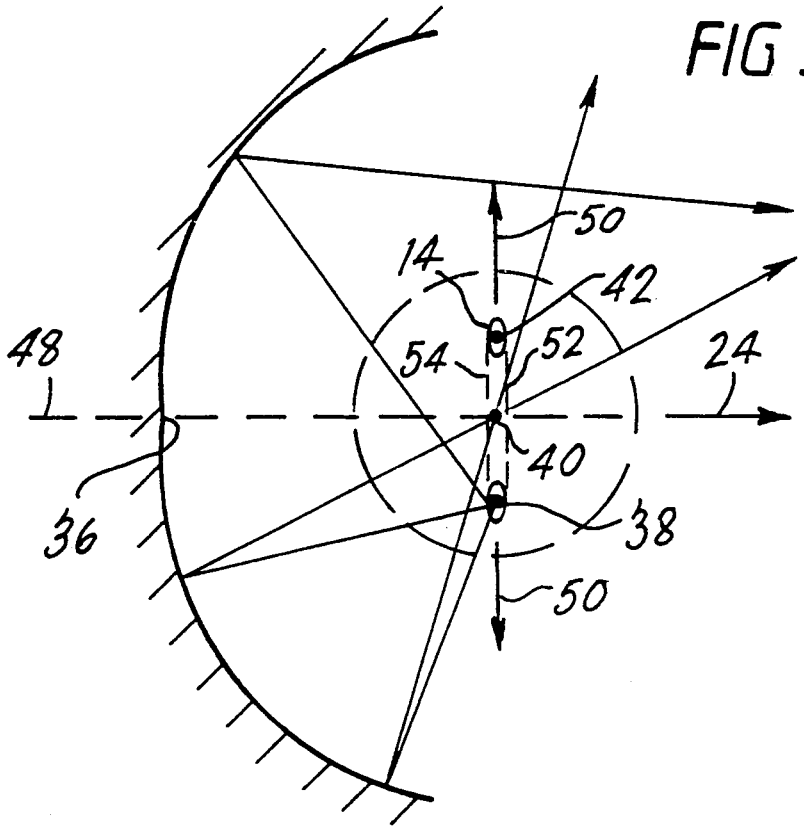
FIG. 3 is a diagrammatic section similar to FIG. 2 but showing a first modification to the embodiment of FIGS. 1 and 2.
Figure 4:
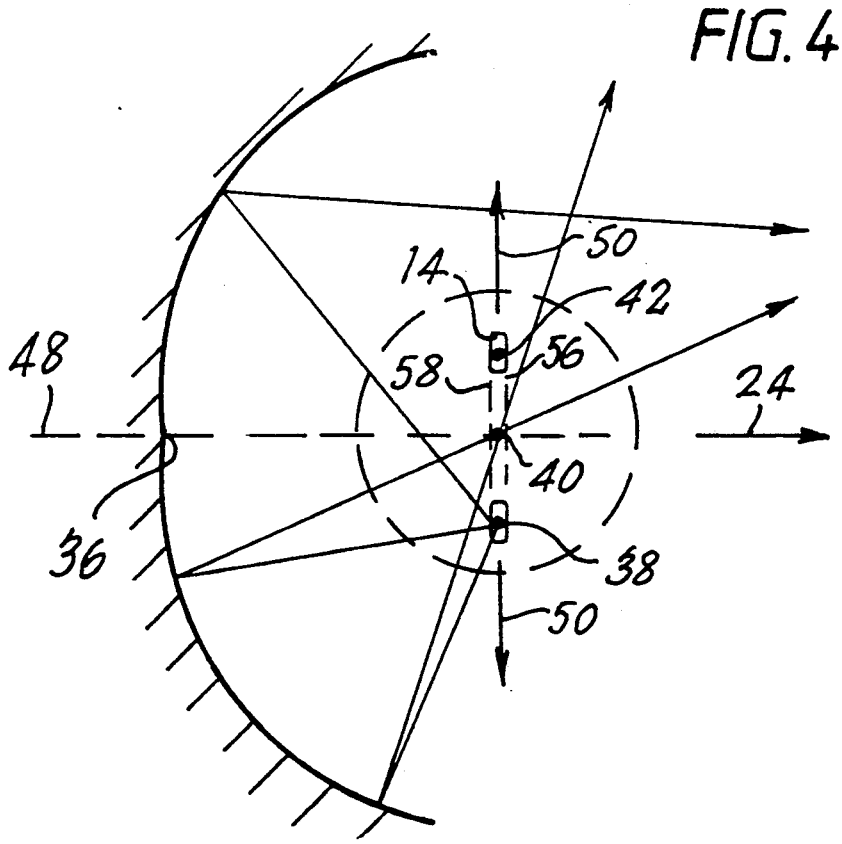
FIG. 4 is a diagrammatic section similar to FIG. 2 showing a second modification to the embodiments of FIGS. 1 and 2.

FIGS. 3 and 4 show modifications to the shape of the filament 14 for the purpose of reducing the amount of light wasted by being emitted generally in the sideways direction 50 as shown in these drawings. In FIG. 3, the windings of the filament 14 are somewhat flattened so that the cross-section of the winding is of oval shape with the major sides 52 and 54 of the oval shape facing respectively in the forward direction indicated by arrow 24 and in the opposite direction thereto. In FIG. 4, the shape of the windings of filament 14 is substantially rectangular with the longer sides of the rectangle 56 and 58 again respectively facing in the forward direction 24 and in the rearward direction opposite thereto. In other respects, the embodiments of FIGS. 3 and 4 are the same as the embodiment of FIGS. 1 and 2.

Figure 5:
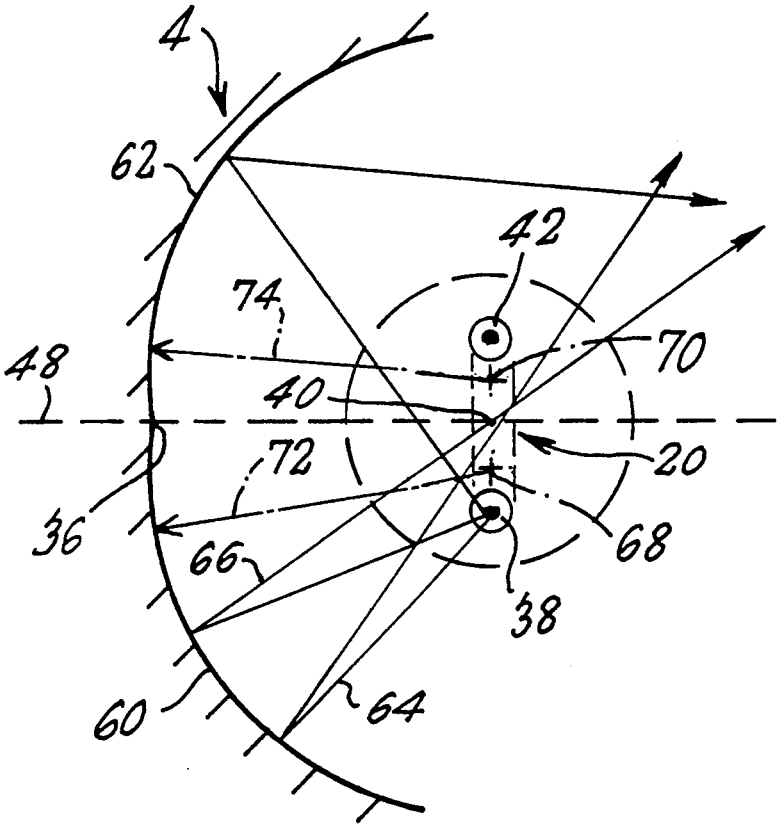
FIG. 5 is diagrammatic section similar to FIG. 2 showing a third modification to the embodiment of FIGS. 1 and 2.

In the embodiment illustrated in FIG. 5 the cross-section of the mirror 4 is made up of two circular arcs 60, 62, instead of the elliptical arcs. To ensure that the light emitted towards the reflector 4, as represented for example by rays 64 and 66 in FIG. 5, is reflected back through the central opening 20, the centers 68, 70 of the circular arcs 60, 62 respectively are offset inwardly relative to the points 38 and 42 and are positioned approximately half way between point 40 and the points 38 and 42 respectively. In FIG. 5, lines 72 and 74 respectively represent the radii of the arcs 60 and 62. Again, in the embodiment of FIG. 5, the shape of the reflector 4 is that described by rotating th arcs, 60, 62 about the line 48, passing through the point 36 where the arcs intersect and the point 40 at the centre of the torroidal filament 14.

The assemblies described with reference to FIGS. 1 to 5 achieve highly efficient use of the light energy emitted by the bulb. The effect is to provide a light source which, from the front, appears to be a solid disc of light bounded by the outer perimeter 22 of the filament 14 and such source may be of substantially uniform intensity over its area. Such a light source is particularly useful in luminaires.

Figure 6:
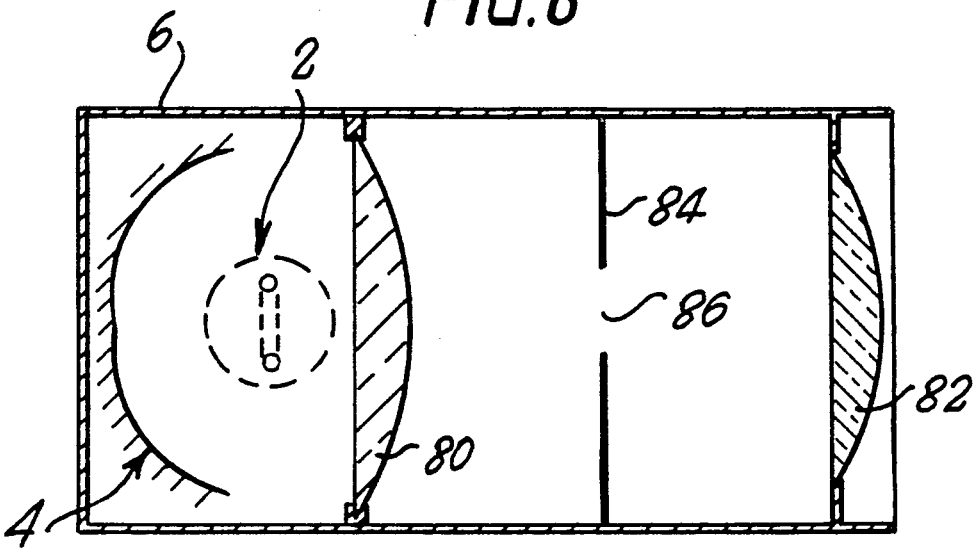
FIG. 6 is a diagrammatic section through a luminaire incorporating an embodiment of the invention.
Figure 7:
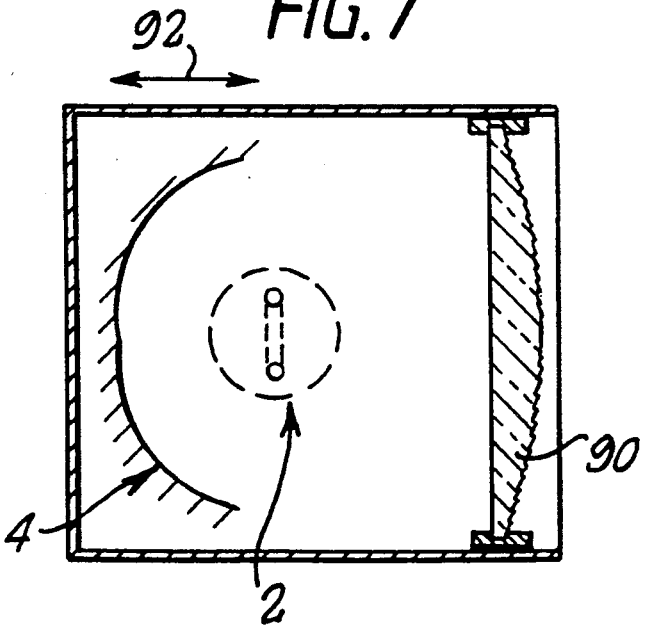
FIG. 7 is diagrammatic section through another form of luminaire incorporating an embodiment of the invention.

FIGS. 6 and 7 show diagrammatically in cross-section examples of luminaires incorporating the assembly of any of FIGS. 1 to 5. In FIG. 6, the lamp 2 and reflector 4 are positioned at one end of the housing 6 and light therefrom is collected by a condenser lens 80 and directed towards an objective lens 82 via a diaphram 84 which has a variable aperture 86 and is positioned between the lenses 80 and 82. The objective lens 82 forms an image of the aperture 86 to give a sharp edged spot on a distant scene, such as a stage etc. The size of the spot may be varied by varying the size of the aperture 86, as is well known.

In FIG. 7, a fresnel lens 90 is positioned to receive light from the lamp 2 and reflector 4 and this is adapted for producing a soft edge spot on a distant scene, such as a stage etc.. The size of the spot is adjustable by moving the lamp 2 and reflector 4 towards or away from the lens 90 as indicated by arrow 92 by a conventional mechanism (not shown). As an alternative to the fresnel lens, a short focus convex lens could be used in FIG. 7.

Various modifications are possible within the scope of the invention. For example, although the elliptical and circular arcs described with reference to the accompanying drawings are preferred, it is possible in practice to depart to some extent from these geometric shapes.

Further, although in the illustrated embodiments, the arcs 32 and 34 and 60 and 62 have been illustrated as meeting at the central point 36, this is not essential. In practice, the central region of the reflector containing point 36 may be, for example, slightly domed or convex due to the manufacturing process used.

Although in the embodiments illustrated in the drawings, the reflector is outside the glass envelope containing the incandescent filament, it would be possible, in accordance with an alternative embodiment of the invention, to provide a lamp and reflector assembly in which the reflector is contained within the envelope in addition to the filament.

Although the embodiments comprise an incandescent bulb, and this for practical reasons is preferred, alternative types of light source may be utilised without departing from the principle of the invention. Further, although the light source has been described as being of torroidal shape, and this is preferred, some departure from this shape is permissable within the scope of the invention.

Although the foci of the elliptical arcs illustrated in FIGS. 2, 3 and 4 have been shown as positioned precisely at the points 38, 40 and 42, some departure from this positioning is possible in practice. Similarly, although it is preferred in the embodiment of FIG. 5 that the centres 68, 78 of the circular arcs 60, 62 are positioned midway between the point 40 and the points 38 and 42 respectively, some departure form this is, again, possible.

We claim:

1. A lamp assembly comprising a light emitting member of generally torroidal shape defining a central light-transmissive opening, and defining a center of said opening, and a reflector positioned and having a shape such as to reflect light received from said light emitting member through said central opening, said reflector having a center, said shape being such that the reflector has a cross-section comprising first and second arcs which are substantially symmetrical with respect to a line joining points at said centers of the reflector and the opening respectively and being that described by rotating said arcs about said line in which each said arc is elliptical and defines first and second foci, in which each said arc has its first focus positioned substantially within said central opening and its second focus positioned substantially within the light emitting member.

2. An assembly according to claim 1, wherein each of said arcs has its first focus positioned substantially at the center of said opening defined by said torroidal member and its second focus positioned at a substantially central position within said torroidal member.

3. An assembly according to claim 1, wherein each of said arcs is substantially circular and defines a respective center and each has its center positioned within said central opening.

4. An assembly according to claim 3, wherein said light emitting member has a center and said centers of said circular arcs are positioned respectively at points substantially half-way between the center of the central opening and points substantially at the center of the light emitting member.

5. A lamp assembly comprising a light emitting member of generally torroidal shape defining a central light-transmissive opening, and defining a center of said opening, and a reflector positioned and having a shape such as to reflect light received from said light emitting member through said central opening, said reflector having a center, said shape being such that the reflector has a cross-section comprising first and second arcs which are substantially symmetrical with respect to a line joining points at said centers of the reflector and the opening respectively and being that described by rotating said arcs about said line, wherein said lamp is an incandescent lamp having a substantially torroidal filament, wherein said filament is helically wound about a generally circular axis in order to provide said torroidal filament, wherein said torroidal shape defines an axis and said helical windings are of generally oval shape with the larger sides of the oval being transverse to said axis of the torroidal shape.

6. A lamp assembly comprising a light emitting member of generally torroidal shape defining a central light-transmissive opening, and defining a center of said opening, and a reflector positioned and having a shape such as to reflect light received from said light emitting member through said central opening, said reflector having a center, said shape being such that the reflector has a cross-section comprising first and second arcs which are substantially symmetrical with respect to a line joining points at said centers of the reflector and the opening respectively and being that described by rotating said arcs about said line, wherein said lamp is an incandescent lamp having a substantially torroidal filament, wherein said filament is helically wound about a generally circular axis in order to provide said torroidal filament, wherein said torroidal shape defines an axis and said windings are of generally rectangular shape with the longer sides of said rectangular shape being transverse to the axis of the torroidal shape.

7. A luminaire comprising a housing and contained within said housing a lamp assembly comprising a light emitting member of generally torroidal shape defining a central light-transmissive opening, and defining a center of said opening, and a reflector positioned and having a shape such as to reflect light received from said light emitting member through said central opening, said reflector having a center, said shape being such that the reflector has a cross-section comprising first and second arcs which are substantially symmetrical with respect to a line joining points at said centers of the reflector and the opening respectively and being that described by rotating said arcs about said line; lens means within said housing for projecting light from said assembly to a distant scene; and means mounted in said housing for defining a variable aperture for forming a sharp-edge spot of variable size at said distant scene.

8. A luminaire according to claim 7, wherein said lens means is operable for forming a soft edge spot of variable size at said distant scene.

9. A luminaire comprising a housing and contained within said housing a lamp assembly comprising a light emitting member of generally torroidal shape defining a central light-transmissive opening, and defining a center of said opening, and a reflector positioned and having a shape such as to reflect light received from said light emitting member through said central opening, said reflector having a center, said shape being such that the reflector has a cross-section comprising first and second arcs which are substantially symmetrical with respect to a line joining points at said centers of the reflector and the opening respectively and being that described by rotating said arcs about said line, and optical focusing means within said housing for projecting light from said assembly to a distant scene wherein the reflector is shaped to concentrate said light received form said light emitting member to a region substantially within said central opening, to provide through said optical means a projected light beam appearing to originate from a uniform disc source including said region and said member.

10. A luminaire according to claim 9 in which each said arc is elliptical and defines first and second foci.

11. A luminaire according to claim 10 in which said arc has its first focus positioned substantially within said central opening and its second focus positioned substantially within the light emitting member.

12. A luminaire according to claim 1 wherein each of said arcs has its first focus positioned substantially at the center of said opening defined by said torroidal member and its second focus positioned at a substantially central position within said torroidal member.

13. A luminaire according to claim 9 wherein each of said arcs is substantially circular and defines a respective center and each has its center positioned within said central opening.

14. A luminaire according to claim 13 wherein said light emitting member has a center and said centers of said circular arcs are positioned respectively at points substantially half-way between the center of the central opening and points substantially at the center of the light emitting member.

15. A luminaire according to claim 9 wherein said lamp is an incandescent lamp having a substantially torroidal filament.

16. A luminaire according to claim 15 wherein said filament is helically wound about a generally circular axis in order to provide said torroidal filament.

17. A luminaire according to claim 16 wherein said helical windings are of generally circular section.

18. A luminaire according to claim 16 wherein said torroidal shape defines an axis and said helical windings are of generally oval shape with the larger sides of the oval being transverse to said axis of the torroidal shape.

19. A luminaire according to claim 16 wherein said torroidal shape defines an axis and said windings are of generally rectangular shape with the longer sides of said rectangular shape being transverse to the axis of the torroidal shape.

20. A method of illuminating a scene in an entertainment environment comprising: providing a luminaire which comprises a housing, a lamp assembly within said housing and an optical system, said assembly comprising a torroidal light source defining a central aperture and a reflector comprising a surface of revolution generatable by rotating a pair of intersecting arcs about their mutual intersection point; energizing the source; reflecting light therefrom form the reflector back through said central aperture so as to concentrate said reflected light at a region substantially within said central aperture; and projecting said reflected light together with unreflected light from said region through said optical system to provide a beam appearing to originate form a source comprising a uniform bright disc.

* * * * *